US008871303B2

(12) United States Patent
Han et al.

(10) Patent No.: US 8,871,303 B2
(45) Date of Patent: Oct. 28, 2014

(54) METHOD FOR PRODUCING TITANIUM METAL

(75) Inventors: Gang Han, Yasugi (JP); Shujiroh Uesaka, Yasugi (JP); Tatsuya Shoji, Yasugi (JP); Mariko Fukumaru (nee ABE), Yasugi (JP); Maher I. Boulos, Sherbrooke, CA (US); Jiayin Guo, Sherbrooke, CA (US); Jerzy Jurewicz, Sherbrooke, CA (US)

(73) Assignees: Hitachi Metals, Ltd., Tokyo (JP); Tekna Plasma Systems Inc., Quebec (CA)

( * ) Notice: Subject to any disclaimer, the term of this patent is extended or adjusted under 35 U.S.C. 154(b) by 0 days.

(21) Appl. No.: 13/322,779

(22) PCT Filed: May 28, 2010

(86) PCT No.: PCT/JP2010/059084
§ 371 (c)(1),
(2), (4) Date: Nov. 28, 2011

(87) PCT Pub. No.: WO2010/137688
PCT Pub. Date: Dec. 2, 2010

(65) Prior Publication Data

US 2012/0070578 A1 Mar. 22, 2012

(30) Foreign Application Priority Data

May 29, 2009 (JP) ..... 2009-130570

(51) Int. Cl.

| | |
|---|---|
| ***C23C 16/00*** | (2006.01) |
| ***C22B 4/00*** | (2006.01) |
| ***C22B 5/04*** | (2006.01) |
| ***C22B 34/12*** | (2006.01) |
| ***C22B 4/08*** | (2006.01) |

(52) U.S. Cl.
CPC ..... *C22B 34/1272* (2013.01); *C22B 4/005* (2013.01); *C22B 5/04* (2013.01); *C22B 4/08* (2013.01)
USPC ..... 427/253; 427/250

(58) Field of Classification Search
CPC ..... C22B 5/04; C22B 34/10; C22B 34/12; C22B 34/1263; C22B 34/1268; C22B 34/1272; C22B 34/1277; C01G 23/022; C23C 14/14; C23C 16/00; C23C 16/06; C23C 16/08
USPC ..... 427/250, 253
See application file for complete search history.

(56) References Cited

U.S. PATENT DOCUMENTS 2,997,385 A 8/1961 Winter, Jr.
4,877,445 A * 10/1989 Okudaira et al. ..... 75/366

(Continued)

FOREIGN PATENT DOCUMENTS

| | | |
|---|---|---|
| JP | 33-3004 B1 | 4/1958 |
| JP | 3-150326 A | 6/1991 |
| JP | 3-150327 A | 6/1991 |

OTHER PUBLICATIONS

D.A. Hansen, et al., "Producing Titanium Powder by Continuous Vapor-Phase Reduction", JOM, Nov. 1998, pp. 56-58, No. 11.

(Continued)

*Primary Examiner* — Kelly M Gambetta
(74) *Attorney, Agent, or Firm* — Sughrue Mion, PLLC

(57) ABSTRACT

Disclosed is a method for producing titanium metal, which comprises: (a) a step in which a mixed gas is formed by supplying titanium tetrachloride and magnesium into a mixing space that is held at an absolute pressure of 50-500 kPa and at a temperature not less than 1700° C.; (b) a step in which the mixed gas is introduced into a deposition space; (c) a step in which titanium metal is deposited and grown on a substrate for deposition; and (d) a step in which the mixed gas after the step (c) is discharged. In this connection, the deposition space has an absolute pressure of 50-500 kPa, the substrate for deposition is arranged in the deposition space, and at least a part of the substrate for deposition is held within the temperature range of 715-1500° C.

9 Claims, 5 Drawing Sheets

(56) References Cited

U.S. PATENT DOCUMENTS

| | | | | |
|---|---|---|---|---|
| 7,914,600 | B2 * | 3/2011 | Withers et al. | 75/366 |
| 2008/0173131 | A1 | 7/2008 | Withers et al. | |
| 2009/0120239 | A1 * | 5/2009 | Jensen et al. | 75/392 |

OTHER PUBLICATIONS

Australian Office Action for Application No. 2010252965 dated Oct. 31, 2012.

Office Action for Chinese Patent Application No. 201080021606.3 dated Aug. 27, 2013.

* cited by examiner

METHOD FOR PRODUCING TITANIUM METAL

CROSS REFERENCE TO RELATED APPLICATIONS

This application is a National Stage of International Application No. PCT/JP2010/058084, filed on May 28, 2010, which claims priority from Japanese Patent Application No. 2009-130570, filed on May 29, 2009, the contents of all of which are incorporated herein by reference in their entirety.

TECHNICAL FIELD

The present invention generally relates to a method for producing titanium metal. More particularly, the invention relates to a method for producing titanium metal by making a titanium metal deposited and grown from a mixed gas of titanium tetrachloride and magnesium.

BACKGROUND OF THE INVENTION

Titanium is a light metal having a high specific strength and exhibiting excellent corrosion resistance. Titanium is widely used in various fields including airplane, medical and automobile industries. An amount of titanium in use has been increasing. Titanium is a plentiful resource and the fourth most abundant element in the earth's crust after aluminum, iron, and magnesium in metal elements. Although titanium is a plentiful resource, titanium has been at least an order of magnitude more expensive than steel materials and is up against short supply.

Currently, titanium metal has been mainly produced by a Kroll Process. In the Kroll Process, titanium ore, the main component of which is titanium dioxide ($TiO_2$), is reacted with a chlorine gas and coke (C) to provide titanium tetrachloride ($TiCl_4$). Subsequently, highly-purified titanium tetrachloride is produced through distillation and separation. Titanium metal is produced by thermal reduction of the purified titanium tetrachloride and magnesium (Mg). In a thermal reduction step of the Kroll Process, a reduction reaction vessel made of stainless steel is filled with a magnesium melt at the temperature of not lower than 800° C. Titanium tetrachloride in a liquid phase is dropped into the vessel from the above and reacts with the magnesium melt in the vessel to produce titanium. The produced titanium sinks in the magnesium melt and thus the titanium is produced in a sponge form. By-product titanium tetrachloride and unreacted magnesium in the liquid phase are mixed with the titanium in the sponge form. Upon completion of the reaction, the reaction mixture is subjected to a vacuum separation process at a high temperature of not lower than 1000° C. to obtain a sponge cake of porous titanium. The sponge cake is crushed to produce sponge titanium.

By the Kroll Process, a titanium material can be produced for practical use. However, a long production time is required since the thermal reduction process and the separation process are preformed separately. Also, the processes are performed batch-wise and have low production efficiency. Accordingly, various techniques have been suggested to overcome the problems of the Kroll Process.

For example, Patent Literature 1 (JP-B-33-3004) discloses a method for collecting titanium including supplying a titanium tetrachloride gas and magnesium in a reaction vessel to cause a gas-phase reaction under a temperature range of 800 to 1100° C. and a vacuum of $10^{-4}$ mmHg ($1.3\times10^{-2}$ Pa) in the vessel and depositing titanium on a net-like collection material disposed in the vessel.

Patent Literature 2 (U.S. Pat. No. 2,997,385) discloses a method for producing metal including introducing halide vapor as a metal element and alkali metal or alkaline earth metal vapor as a reducing agent into a reaction vessel to cause a gas-phase reaction in the vessel in an evacuated state under a temperature range of 750 to 1200° C. and a pressure of 0.01 to 300 mmHg (1.3 Pa to 40 kPa).

Example II disclosed in Patent Literature 2 discloses that titanium was produced by $TiCl_4$ gas and Mg gas. More specifically, the reaction was caused under a reaction temperature of approximately 850° C. and a pressure of 10 to 200 microns (1.3 to 26.7 Pa).

Non Patent Literature 1 (D. A. Hansen and S. J. Gerdemann, JOM, 1998, No. 11, page 56) discloses a method for producing titanium ultrafine powders through a gas-phase reaction. According to the method, titanium tetrachloride gas and magnesium gas are introduced into a reaction vessel and reacted at a temperature of not lower than 850° C., and produced titanium ultrafine powders and concomitantly produced $MgCl_2$ powders are separated in a cyclone provided on a lower portion. Then, magnesium and $MgCl_2$ are separated from the obtained titanium ultrafine powders through vacuum distillation or filtration.

CITATION LIST

Patent Literature

[Patent Literature 1] JP-B-33-3004
[Patent Literature 2] U.S. Pat. No. 2,997,385

Non Patent Literature

[Non Patent Literature 1] D. A. Hansen and S. J. Gerdemann, JOM, 1998, No. 11, page 56

SUMMARY OF THE INVENTION

According to searches by the inventors, a small amount of titanium can be collected by the method disclosed in Patent Literature 1, but supply rate of reactants is required to be limited in order to maintain a vacuum state to $10^{-4}$ mmHg in a reaction vessel. Treatment ability may be increased by increasing size of a vacuum pump and exhaust capability. However, it is difficult to obtain a large amount of titanium for industrial use.

By the method disclosed in Patent Literature 2, purified titanium can be collected as well as by the method disclosed in Patent Literature 1. However, the production rate is low in a low-pressure state.

Powder size produced by the method disclosed in Non Patent Literature 1 is in an approximately submicron range and thus magnesium and $MgCl_2$ can not be efficiently separated from the powder. Accordingly, large amount of impurities are mixed. Thus, the method requires an independent means for separation, such as vacuum distillation, is required.

As described above, the cited literatures suggest methods for producing titanium through a gas-phase reaction of titanium tetrachloride gas and magnesium gas in order to overcome the problems of the Kroll Process. However, according to these methods, it is essentially required to separate by-product $MgCl_2$ or unreacted magnesium in a highly evacuated state, and thus it is difficult to obtain a large amount of titanium.

An object of the present invention is to provide a method for effectively producing titanium metal from titanium tetrachloride and magnesium as starting materials.

According to an aspect of the present invention, provided is a method for producing titanium metal includes the steps of: (a) supplying titanium tetrachloride and magnesium into a mixing space at an absolute pressure of 50 to 500 kPa and at a temperature of not lower than 1700° C. to form a mixed gas; (b) introducing the mixed gas into a deposition space; (c) depositing and growing the titanium metal on a substrate for deposition; and (d) discharging the mixed gas after the step (c). The deposition space has an absolute pressure of 50 to 500 kPa. The substrate for deposition is arranged in the deposition space, and at least a part of the substrate is at a temperature of 715 to 1500° C.

The mixing space and the deposition space are preferably communicated with each other via an orifice so that the mixed gas is transferred from the mixing space into the deposition space through the orifice.

The substrate is preferably made of the titanium metal.

The substrate preferably has a shape extending in a direction where the mixed gas flows to form a flow path of the mixed gas.

Preferably, at least a part of the substrate is at a temperature of 900 to 1300° C., more preferably 900 to 1200° C.

Further, an ingot of the titanium metal may be continuously produced by drawing downwardly the substrate depending on deposition and growth rate of the titanium metal.

According to the method for producing titanium metal, titanium can be directly produced by a gas-phase reaction between titanium tetrachloride and magnesium. Thus, highly-purified titanium can be produced with a highly productivity. Also, an ingot of the titanium metal can be continuously produced by drawing downwardly the substrate depending on deposition and growth rate of the titanium metal.

The above-described object and other objects, advantages, and features will be apparent from following non-restrictive embodiments with reference to accompanying drawings.

DETAILED DESCRIPTION OF THE INVENTION

Figure 1A:
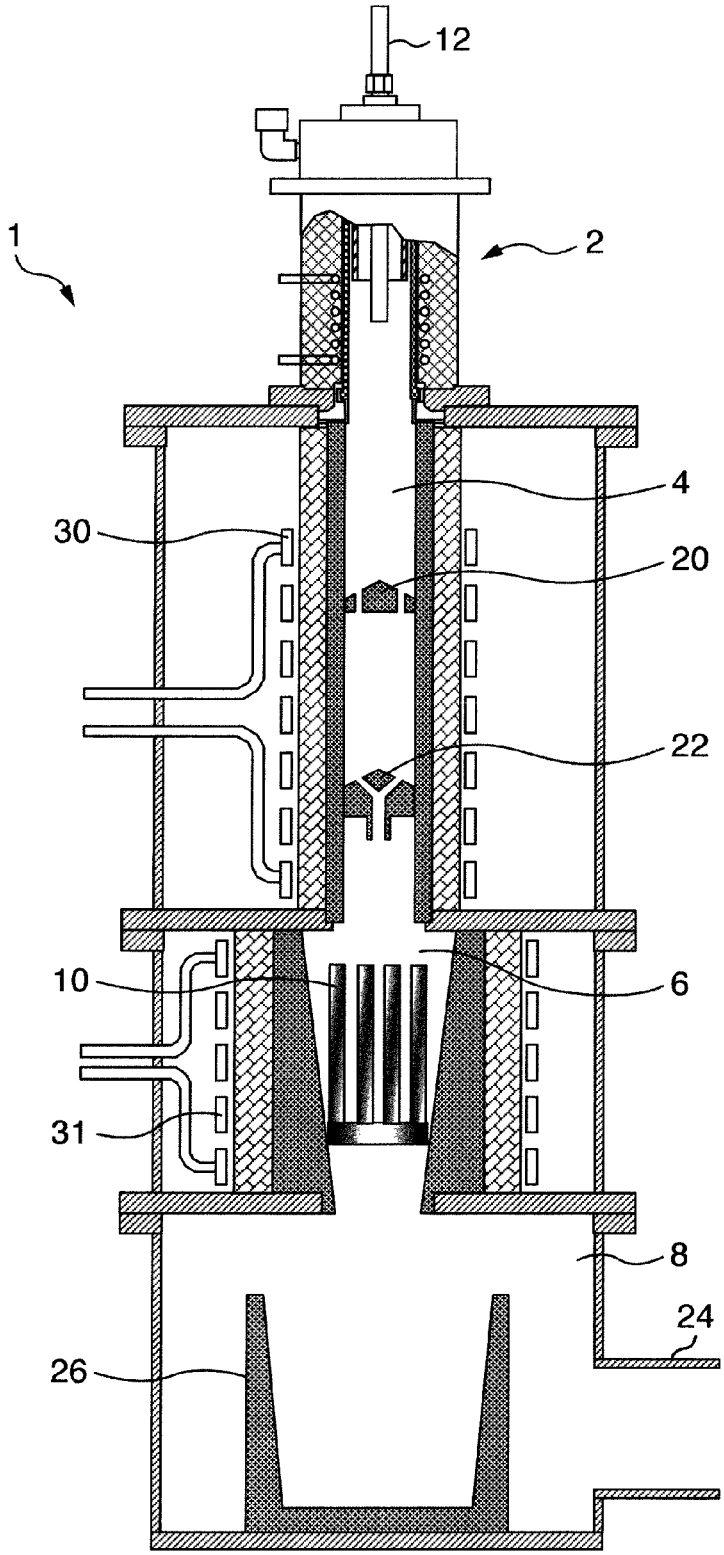
FIG. 1A is a schematic sectional side view of an apparatus for producing titanium metal according to an embodiment of the invention.

The invention discloses a new method for producing titanium metal.

A mixed gas is formed by supplying a titanium tetrachloride gas and a magnesium gas into a mixing space at an absolute pressure of 50 to 500 kPa and at a temperature of not lower than 1700° C. Since the mixed gas is formed by mixing titanium tetrachloride gas and magnesium gas in advance, continuous and uniform reaction can be carried out in a reaction vessel. Since a driving force for generating the reaction between titanium tetrachloride and magnesium decreases depending on increase of temperature, the reaction can be substantially suppressed at the temperature of not lower than 1700° C. and therefore mixing of the reactant gases can be performed.

Next, the mixed gas is introduced into a deposition space. The deposition space has an absolute pressure of 50 to 500 kPa. A substrate for deposition is arranged in the deposition space, and at least a part of the substrate is in a temperature range of 715 to 1500° C. A driving force for the reaction of generating titanium is increased as a temperature of the mixed gas decreases. A surface of the substrate arranged in the deposition space promotes heterogeneous nucleation and promotes generation and deposition of titanium.

One of the significant characteristics of the invention is that the absolute pressure of the deposition space is 50 to 500 kPa. Lower pressure in the deposition space is advantageous for evaporation separation of magnesium and $MgCl_2$. Even when the reaction occurs un-uniformly, by-products or intermediate compounds can be evaporated and separated since vacuum depressurization facilitates the evaporation. In fact, titanium is produced by vacuum separation under a pressure of 0.1 to 1 Pa and at a temperature of 1000° C. in Kroll Process.

However, the method of the invention employs the absolute pressure of 50 to 500 kPa that is almost the same as atmospheric pressure. According to the cited literatures, magnesium and $MgCl_2$ can not be separated from titanium under such a pressure. The inventors have found that titanium is crystallized and grown on the substrate even under such a pressure that is not traditionally used, and surprisingly, the titanium deposition has high purity.

While reason thereof is not clear, it is assumed that removal of impurities during crystal growth of titanium and partial heat exchange by deposition may contribute to the above.

In general, treatment capability per unit reactor volume is increased with an increase of a reactor pressure. For example, when a pressure is increased by one order of magnitude, treatment capability is increased by one order of magnitude. In the invention, treatment capability can be remarkably improved since the pressure as described above can be applied, which has not been used hitherto.

Although titanium can be collected in principle even under a pressure of less than 50 kPa, production rate is reduced with reduction of the pressure and possibility of air leakage into an apparatus is increased. Since titanium has high reactive activity with oxygen and nitrogen, it is required to protect the production process from outer air. As a degree of vacuum increased, cost for preventing the air leakage during the process in the apparatus is increased. Under a pressure of not lower than 50 kPa, the air leakage can be easily prevented at an industrial production level. Thus, the pressure range of not lower than 50 kPa is preferable for practical use.

Although treatment capability per unit reactor volume is increased with increase of a pressure, evaporation efficiency of $MgCl_2$ is reduced. Therefore, when the pressure exceeds 500 kPa, it becomes difficult to produce highly-purified titanium. In addition, production cost is increased to deal with high pressure in industrial equipment. Thus, pressure of not greater than 500 kPa is effective.

In view of treatment capability, separation efficiency, and economic rationality of industrial equipment, a preferable range of absolute pressure is 90 to 200 kPa.

In a temperature range of 715 to 1500° C., highly-purified titanium can be deposited as particles on a substrate under a pressure of 50 to 500 kPa. As a temperature is decreased, a driving force for generating the reaction is increased and evaporation efficiency of magnesium and $MgCl_2$ is reduced. On the contrary, as a temperature is increased, $MgCl_2$ and the like are efficiently evaporated and the driving force is reduced. At a temperature of not lower than 1500° C., reduction reaction of titanium does not easily proceed. At a temperature of not higher than 715° C., homogeneous nucleation of reaction gas occurs and titanium is not easily deposited on the substrate. Accordingly, a temperature of at least a part of the substrate is preferably in a range of 715 to 1500° C.

Operation at a lower temperature is desirable for a structural material of a reaction vessel as well as stable titanium deposition is generated. In view of possibility of mixing of $MgCl_2$ or the like at a lower temperature, a temperature range is preferably 900 to 1300° C., more preferably 900 to 1200° C. to realize stable industrial production.

In the invention, a substrate for deposition is arranged in the deposition space to ensure a contact area with the mixed gas. When the substrate is arranged in the space in the reaction vessel, it serves as a precipitation site for introduced mixed gas and titanium metal can be deposited and grown on the substrate.

A surface of the substrate provides a place for heterogeneous nucleation of titanium produced by the reaction and promotes its deposition. The substrate desirably has a shape which the mixed gas can pass through and contact the substrate. Therefore, it is desirable that the substrate has a space therein with a large surface area so that the mixed gas sufficiently flow therethrough. A porous structure is preferable to ensure a specific surface area of the substrate. Also, it is preferable that the substrate has a shape extending in a direction where the mixed gas flows and forms a flow path of the mixed gas.

It is desirable to provide a mechanism for drawing downward the substrate depending on deposition and growth rate of the titanium metal in order to collect the deposited titanium metal continuously. Since the inventors observed that the titanium metal deposited in a large amount at a distal end (an end surface facing a flow of the mixed gas) of the substrate, the titanium deposited on the end surface can be continuously grown by drawing the end surface.

Titanium deposited on the substrate may be collected by adding a scraper function for scratching off the titanium on the surface of the substrate or by providing a plurality of substrates which are mutually slid to scratch off the deposited titanium. Alternatively, the titanium particles on the substrate may be continuously collected by applying vibration to the substrate.

Furthermore, the substrate may be cooled in order to take a reaction heat for controlling a temperature of reacting.

Material for the substrate used in the invention is not particularly limited. For example, ceramic or metal may be used. For effective deposition, the material preferably has a crystalline structure similar to that of titanium. In particular, pure titanium or titanium alloy is preferable as the material.

More particularly, pure titanium is a desirable for the substrate in order to maintain a degree of purity of collected titanium and prevent mixing of impurities.

The mixing space and the deposition space are preferably partitioned by an orifice connecting the spaces. Thus, temperatures in the mixing space and the deposition space are independently controlled. Mixing efficiency of reactant gas in the mixing space can be improved due to the orifice. Also, a through hole having a predetermined angle or a fin for generating a turning flow may be provided in the mixing space for assisting formation of the mixed gas in the mixing space.

Figure 1B:
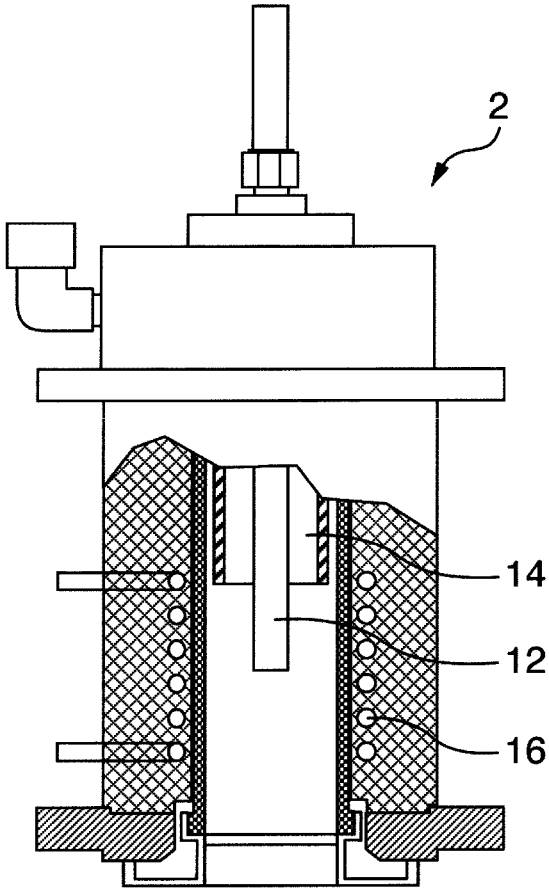
FIG. 1B is an enlarged view of a plasma torch shown in FIG. 1.

FIG. 1A is a schematic sectional side view of an apparatus used for producing titanium metal according to an embodiment of the invention. FIG. 1B is an enlarged view of a plasma torch 2. The plasma torch 2 is provided on an upper portion of the apparatus 1 as a thermal source. In the plasma torch 2, an RF coil 16 is wound around a cylindrical tube of ceramic or quartz glass and is connected to an electrical power. A plasma flame is produced by electromagnetic induction in a space of the cylindrical tube. A gas feeding unit 14 for supplying plasma gas and a feeding unit 12 for supplying titanium tetrachloride and magnesium are provided at a top portion of the plasma torch 2. The feeding unit 12 is arranged such that an outlet of a nozzle is positioned in alignment with a center of the coil. Chambers 4, 6, and 8 are connected to each other on the downstream of the plasma torch 2. The plasma torch 2, the chambers, and connection parts between the chambers are sealed. An exhaust chamber 8 has a port 24 connected to an exhaust unit.

According to an embodiment of the invention, heaters 30 and 31 may be provided around at least a part of side wall/walls of the mixing chamber 4 and/or the deposition chamber 6 such that temperature in the chambers can be increased to a predetermined level. Inner walls of the chambers may be made of a material having corrosion resistance against a chloride vapor. For example, the corrosion resistant material may be graphite. According to another embodiment of the invention, the mixing chamber 4 and/or the deposition chamber 6 can be heated using a heater including a coil positioned within or outside the chambers. When the coil is positioned outside the chambers, the chambers can be heated through induction-heating of the graphite walls of the chambers. The combined heating with the heater, RF thermal plasma, and exothermal reaction may be controlled to keep the chambers at a predetermined temperature. Other heating means may be used as a heating source.

The feeding unit 12 for supplying titanium tetrachloride and magnesium has a double-tube structure. Titanium tetrachloride is supplied in a liquid or gaseous state through an outer circumferential tube of the feeding unit 12 together with a carrier gas, for example, argon gas. Magnesium in a melt or powder form is supplied into a thermal plasma flame through a central tube of the feeding unit 12. Since titanium tetrachloride and magnesium are supplied through separated flow paths, they are not mixed until they reach the mixing space. Titanium tetrachloride and magnesium are evaporated in the plasma flame and mixed in the mixing space 4 to form a mixed gas. However, when the mixing space 4 is maintained under conditions of an absolute pressure of 50 to 500 kPa and a temperature of not lower than 1700° C., titanium tetrachloride and magnesium do not cause a reduction reaction. In this embodiment, provided is a mixer 20 with a through hole at an angle to generate a turning flow in a direction of the angle in the mixing chamber 4, in order to reliably mix titanium tetrachloride and magnesium.

In an embodiment shown in FIGS. 1A and 1B, titanium tetrachloride and magnesium are supplied along a central axis of the chambers from a nozzle of the feeding unit 12. In other embodiment, titanium tetrachloride and magnesium may be supplied through a plurality of nozzles toward the central axis from outside of the RF plasma flame.

Plasma gas is required to be supplied by being divided into a sheath gas in an axial direction and a central gas in a tangential direction in order to stably maintain the RF plasma flame in the plasma torch 2. In the embodiment shown in FIGS. 1A and 1B, the plasma gas supplied from a feeding unit 14 positioned at outer circumference of the feeding unit 12 forms a turning flow in the tangential direction, and consequently promotes mixing of titanium tetrachloride and magnesium.

The plasma gas is supplied through the gas feeding unit 14, and the RF power is applied with use of an RF power source. The plasma gas may be selected from a group consisting of argon (Ar), helium (He), hydrogen ($H_2$), and mixtures thereof. Other plasma gasses are known in the art, and those skilled in the art may appropriately select and use them. In the embodiment, an inert gas is preferably used in order to avoid generation of impurities and contamination due reactions with titanium. In other embodiment, a mixed gas of argon and helium is used as the plasma gas. When the mixed gas of argon and helium is used, a shape, thermal conductivity, flow resistance, and ionization states of the plasma flame can be controlled by controlling factors such as the operating pressure or Ar/He ratio.

An orifice 22 is provided on a lower portion of the mixing chamber 4. The mixed gas flows into the deposition chamber 6 below through the orifice 22. The orifice can be adjusted such that a flow of the mixed gas is directed to the substrate 10 for deposition.

The deposition chamber 6 is maintained at an absolute pressure of 50 to 500 kPa. The substrate 10 is located in the deposition chamber 6. A temperature of the deposition chamber is controlled such that at least a part of the substrate 10 has a temperature in a range of 715 to 1500° C. Preferably, the temperature of at a least part of the substrate 10 is in a range of 900 to 1200° C.

The mixed gas of titanium tetrachloride and magnesium having passed through the orifice causes a reduction reaction of titanium tetrachloride by magnesium at the temperature in the above range. Then, produced titanium is deposited and grown on the surface of the substrate.

According to an embodiment, the substrate has a shape extending along a direction in which the mixed gas flows and includes a flow path therein of the mixed gas. Preferably, the substrate has a large surface area for deposition while ensuring sufficient flow path for flowing the mixed gas. In an embodiment, the substrate is made of titanium metal. According to an embodiment, the substrate is formed by binding band-shaped metal plates twisted in a spiral form and is positioned so that the extending direction of the band-shaped materials is directed to a longitudinal direction of the chambers. According to other embodiment, slits 42 are formed on the metal plate from right and left sides to leave a central portion 40 (FIG. 3B) and the metal plate is twisted in a spiral form around the central portion (FIG. 3A) to provide the substrate.

An exhaust plasma gas flows into an exhaust chamber 8 and discharged through an exhaust duct.

A holder 26 for collecting by-product $MgCl_2$ or unreacted magnesium may be provided in the exhaust chamber. Magnesium chloride is collected from the exhaust gas discharged through an exhaust port 24 by a filter or the like.

An embodiment of an apparatus used in the invention is described above. By drawing the substrate 10 downwardly depending on a deposition rate of titanium, deposition and growth of titanium are continued. Accordingly, an ingot of the titanium metal can be continuously produced.

Example 1

Examples exemplifying efficiency of the method for producing titanium metal according to the invention will be explained hereinbelow. An apparatus used in Example 1 has a structure in FIG. 1A. As a plasma torch, an induction coil was wound with five turns around a cylindrical ceramic tube having an inner diameter of 50 mm, and connected to a power source of 60 kW. A feeding unit was located in the torch such that an outlet of the unit was substantially in alignment with a center of the coil. A mixing chamber, a deposition chamber, and an exhaust chamber were arranged below the plasma torch. A mixer and an orifice were arranged in the mixing chamber. A substrate for deposition was formed by binding titanium strips twisted in a spiral form and arranged in the deposition chamber. The titanium strip had a width of 5 mm, a thickness of 1 mm, and a length of 180 mm. 20 titanium strips were twisted in a longitudinal direction and bound to be located along a longitudinal direction of the chambers. An exhaust port connected to an exhaust system was provided in the exhaust chamber. A graphite crucible was arranged in a holder 26 in the exhaust chamber. An induction-heating coil 30 was provided on an outer circumference of the mixing chamber and an induction-heating coil 31 was provided on an outer circumference of the deposition chamber so that a temperature in each chamber was controlled by induction-heating.

Figure 4:
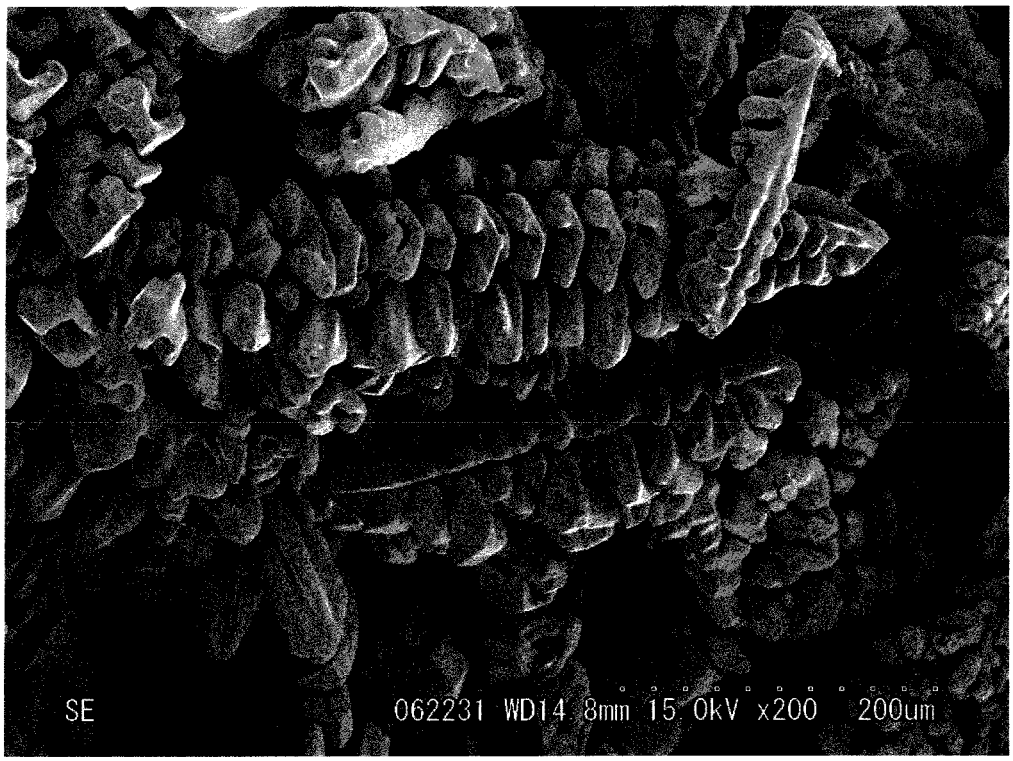
FIG. 4 is an SEM image of titanium metal particles obtained according to an embodiment of the present invention.

Under conditions of a plasma output of 60 kW and a carrier gas with Ar:He being 77 slpm (average liter per minute):15 slpm, titanium tetrachloride in a liquid phase was delivered at 22.7 ml/min (milliliter per minute) and magnesium was delivered at 11.5 g/min for 33 minutes. Consequently, 150.6 g of titanium metal was collected from the substrate. A power of the induction-heating coil 30 was controlled to be 16 kW and a temperature of the mixing chamber was controlled to be in a range of 1750 to 1830° C. A pressure in the mixing chamber was 108 kPa. A power of the induction-heating coil 31 was controlled to be 6 kW. The substrate was controlled to have a temperature of 1180 to 1250° C. and a pressure of 105 kPa. A bulk of titanium metal was formed on the substrate. Its image observed by an electron scanning microscope is shown in FIG. 4. A microstructure includes grown dendrite crystals. By analyzing the collected titanium metal by a GDMS method, it was found that highly-purified titanium with purity of not lower than 99.8% was obtained.

Example 2

Figure 2:
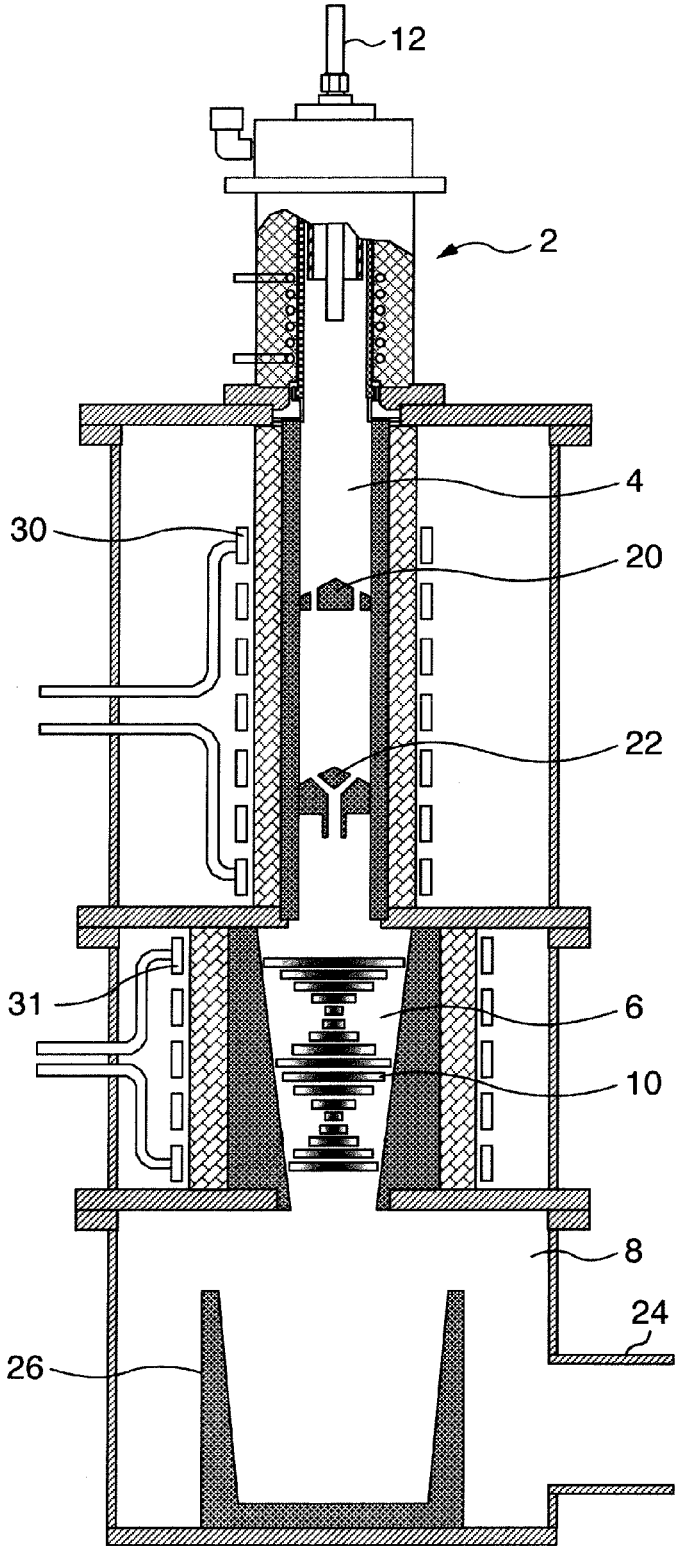
FIG. 2 is a schematic sectional side view of a apparatus for producing titanium metal according to another embodiment of the invention.
Figure 3A:
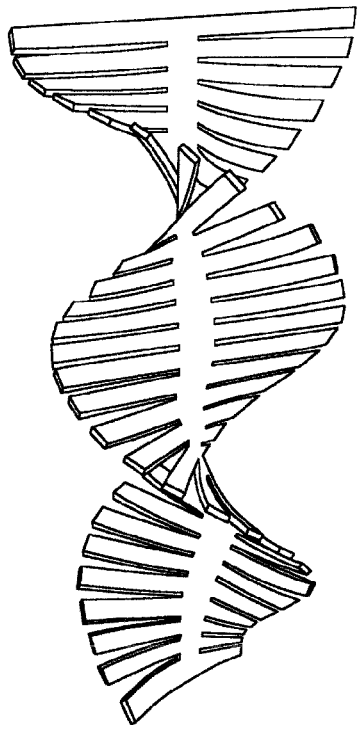
FIG. 3A shows a substrate for deposition according to an embodiment of the invention.
Figure 3B:
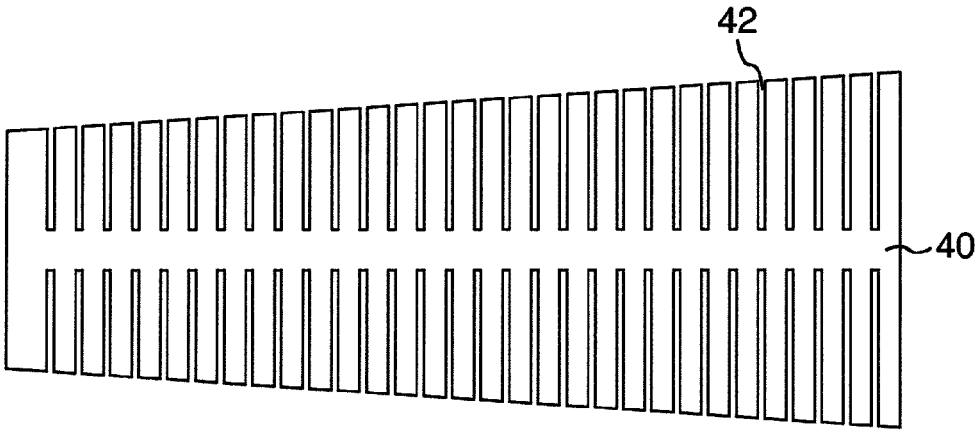
FIG. 3B is a development view of the substrate shown in FIG. 3A.

The same apparatus as in Example 1 was used in Example 2. As a substrate for deposition, metal plate are provide with slits 42 from right and left sides and twisted around a central portion in a spiral form as shown in FIG. 3A. FIG. 2 is a schematic sectional side view of the experimental apparatus. Under conditions of plasma output of 60 kW and a carrier gas with Ar:He of 77 slpm:15 slpm, titanium tetrachloride in a liquid phase was delivered at 22.7 ml/min and magnesium was delivered at 11.7 g/min for 27 minutes. Consequently, 150.6 g of titanium was collected. Power of an induction-heating coil 30 was controlled to be 14 kW and a temperature of a mixing chamber was controlled to be in a range of 1720 to 1780° C. A pressure in a mixing chamber was 108 kPa. Power of an induction-heating coil 31 was controlled to be 4 kW. The substrate was controlled to have a temperature of 1150 to 1200° C. and a pressure of 105 kPa. Collected titanium was analyzed with the GDMS method, and it was found that highly-purified titanium with purity of not lower than 99.9% was obtained.

Example 3

Same apparatus as in Example 2 was used in Example 3 (the substrate for deposition shown in FIG. 3A was used). Under conditions of plasma output of 61 kW and carrier gas with Ar:He of 77 slpm:15 slpm, titanium tetrachloride in a liquid phase was delivered at 22.5 ml/min and magnesium was delivered at 12.0 g/min for 25 minutes. Consequently, 137.8 g of titanium was collected. Power of an induction-heating coil 30 was controlled to be 14 kW and a temperature of a mixing chamber was controlled to be in a range of 1740 to 1800° C. A pressure in a mixing chamber was 108 kPa. Power of an induction-heating coil 31 was controlled to be 6 kW. The substrate was controlled to have a temperature of 1120 to 1210° C. and a pressure of 105 kPa. Collected titanium was analyzed with the GDMS method, and it was found that highly-purified titanium with purity of not lower than 99.9% was obtained.

Example 4

Same apparatus as in Example 2 was used in Example 4 (the substrate for deposition shown in FIG. 3A was used). Under conditions of plasma output of 60 kW and carrier gas with Ar:He of 77 slpm:15 slpm, titanium tetrachloride in a liquid phase was delivered at 20.6 ml/min and magnesium was delivered at 12.0 g/min for 24 minutes. Consequently, 100 g of titanium was collected. Power of an induction-heating coil 30 was controlled to be 12 kW and a temperature of a mixing chamber was controlled to be in a range of 1720 to 1750° C. A pressure in a mixing chamber was 108 kPa. Power of an induction-heating coil 31 was controlled to be 3 kW. The substrate was controlled to have a temperature of 990 to 1150° C. and a pressure of 105 kPa. Collected titanium was analyzed with the GDMS method, and it was found that highly-purified titanium with purity of not lower than 99.9% was obtained.

Example 5

Same apparatus as in Example 2 was used in Example 5 (the substrate for deposition shown in FIG. 3A was used). Under conditions of plasma output of 61 kW and carrier gas with Ar:He of 77 slpm:15 slpm, titanium tetrachloride in a liquid phase was delivered at 21.3 ml/min and magnesium was delivered at 11.6 g/min for 23 minutes. Consequently, 80 g of titanium was collected. Power of an induction-heating coil 30 was controlled to be 13 kW and a temperature of a mixing chamber was controlled to be in a range of 1720 to 1780° C. Pressure in a mixing chamber was 108 kPa. Power of an induction-heating coil 31 was controlled to be 9 kW. The substrate was controlled to have a temperature of 1250 to 1500° C. and a pressure of 105 kPa. Collected titanium was analyzed with the GDMS method, and it was found that highly-purified titanium with purity of not lower than 99.9% was obtained.

By the method according to the invention, titanium having purity of not lower than 99.8% can be produced and the produced titanium metal is suitable for a material for melting or a powder metallurgy. The method can be also applied in producing an ingot for electronic materials, aircraft parts, or power and chemical plants.

Embodiments of the method for producing titanium metal according to the invention are explained above. However, the invention is not limited thereto, and can be modified without departing from the spirit and scope of the present invention as defined in the appended claims.

REFERENCE NUMERALS

1 apparatus for producing titanium metal
2 plasma torch
4 mixing chamber
6 deposition chamber
8 exhaust chamber
10 substrate for deposition
12 feeding unit
14 gas feeding unit
16 RF coil
20 mixer
22 orifice
24 exhaust port
26 holder
30, 31 heater

The invention claimed is:

1. A method for producing titanium metal, including steps of:

(a) forming a mixed gas by supplying titanium tetrachloride and magnesium into a mixing space, the mixing space being held at an absolute pressure of 50 to 500 kPa and at a temperature of not lower than 1700° C.;

(b) introducing the mixed gas into a deposition space held at an absolute pressure of 50 to 500 kPa, a substrate for deposition being located in the deposition space, at least a part of the substrate being held at a temperature of 715 to 1500° C.;

(c) depositing and growing titanium metal on the substrate; and (d) discharging the mixed gas after the step (c);

wherein the mixing space and the deposition space are communicated with each other via an orifice, and the mixed gas flows from the mixing space into the deposition space through the orifice.

2. The method according to claim 1, wherein the substrate is made of titanium metal.

3. The method according to claim 1, wherein the substrate has a shape extending in a direction along a flow of the mixed gas and includes a flow path of the mixed gas.

4. The method according to claim 1, wherein at least a part of the substrate is held at a temperature of 900 to 1200° C.

5. The method according to claim 1, further comprising a step of drawing the substrate downwardly depending on deposition and growth rate of the titanium metal to produce an ingot of the titanium metal continuously.

6. The method according to claim 1, wherein the pressure in the mixing space is 108 to 500 kPa.

7. The method according to claim 1, wherein the pressure in the deposition space is 105 to 500 kPa.

8. The method according to claim 1, wherein the pressure in the mixing space is 108 to 500 kPa and the pressure in the deposition space is 105 to 500 kPa.

9. The method according to claim 1, wherein the orifice is adjusted such that a flow of the mixed gas is directed to the substrate for deposition.

* * * * *